US007966748B2

(12) United States Patent
Votolato

(10) Patent No.: US 7,966,748 B2
(45) Date of Patent: Jun. 28, 2011

(54) ELASTIC OVERSHOE WITH SANDWICHED SOLE PADS

(75) Inventor: Earl Votolato, Newport Beach, CA (US)

(73) Assignee: Earl J. & Kimberly Votolato, Trustees of the Votolato Living Trust, Newport Beach, VA (US)

( * ) Notice: Subject to any disclaimer, the term of this patent is extended or adjusted under 35 U.S.C. 154(b) by 775 days.

(21) Appl. No.: 11/867,638

(22) Filed: Oct. 4, 2007

(65) Prior Publication Data

US 2008/0250666 A1 Oct. 16, 2008

Related U.S. Application Data

(60) Provisional application No. 60/912,141, filed on Apr. 16, 2007.

(51) Int. Cl.
*A43B 7/06* (2006.01)
*A43B 3/16* (2006.01)

(52) U.S. Cl. ..... 36/15; 36/100; 36/7.1 R

(58) Field of Classification Search ..... 36/100, 36/101, 15, 7.1 R, 59 R, 61, 4, 62
See application file for complete search history.

(56) References Cited

U.S. PATENT DOCUMENTS

| | | | | | |
|---|---|---|---|---|---|
| 429,429 | A * | 6/1890 | Eckhardt | 36/3 B |
| 997,657 | A * | 7/1911 | Drake | 36/129 |
| 3,191,321 | A * | 6/1965 | Brutting | 36/133 |
| 4,434,565 | A * | 3/1984 | Haley | 36/7.3 |
| 4,747,220 | A * | 5/1988 | Autry et al. | 36/59 R |
| 5,077,916 | A * | 1/1992 | Beneteau | 361/114 |
| 5,367,791 | A * | 11/1994 | Gross et al. | 36/31 |
| 6,023,859 | A * | 2/2000 | Burke et al. | 36/105 |
| 6,836,979 | B2 * | 1/2005 | Flavio et al. | 36/103 |
| 6,904,705 | B2 * | 6/2005 | Polegato Moretti | 36/11 |
| 7,140,129 | B2 * | 11/2006 | Newson et al. | 36/100 |
| 7,444,763 | B2 * | 11/2008 | Grove et al. | 36/15 |
| 7,523,566 | B2 * | 4/2009 | Young-Chul | 36/30 R |
| 2005/0188562 | A1 * | 9/2005 | Clarke et al. | 36/15 |

* cited by examiner

*Primary Examiner* — Marie Patterson
(74) *Attorney, Agent, or Firm* — Fish & Associates, PC

(57) ABSTRACT

An elastic overshoe has an outer layer through which extend a plurality of protrusions. The protrusions are preferably carried on an inner layer, which is sandwiched between the outer layer and the shoe upon which the overshoe is placed. Inner layer segments can run the length of the overshoe, or more preferably include only a ball region of a toe region. The openings can have any practical size, shape, orientation and arrangement of openings, although of course at least some of the openings must be aligned with at least some of the protrusions, and ideally the protrusions will fit snugly within the openings to avoid tearing of the openings. The inner and outer layers can advantageously have different chemical compositions. The inner layer, for example, can be tougher, while the outer layer could be more stretchable.

16 Claims, 3 Drawing Sheets

ELASTIC OVERSHOE WITH SANDWICHED SOLE PADS

This application claims priority to U.S. Provisional Application Ser. No. 60/912,141 filed on Apr. 16, 2007, which is incorporated herein in its entirety.

FIELD OF THE INVENTION

The field of the invention is overshoes (shoe covers).

BACKGROUND

Elastic overshoes of various types have been known for decades. They are typically worn to keep the wearer's feet warm and dry during cold and/or wet weather, but are also used in hospitals, restaurants, factories, and other areas where floors can be slippery.

Previously known overshoes generally comprise a unitary construction, such as, for example, that found in a continuous molded rubber product. This is done to facilitate construction of the overshoe using a single, inexpensive molding process. Unfortunately, in such cases both the upper region and the sole are necessarily made of the same material, which is then intended to satisfy the competing needs of elasticity and grip.

One solution to these competing needs is to fashion the sole with a raised tread pattern. Such tread patterns are designed to improve traction and thus reduce the likelihood of the wearer accidentally slipping. Although somewhat effective, the inherent tradeoff resulting from the use of a given material usually means that either the overshoe is insufficiently elastic (requiring manufacture and stocking of many different sizes), or the overshoe has insufficient traction.

There is yet a third tradeoff, namely that materials satisfying both elasticity and traction can have undesirable durability characteristics. Among other things previously known overshoes tend to wear out prematurely, rip, or in some other manner become dysfunctional.

Thus, there is still a need for an overshoe that has adequate elasticity, as well as enhanced slip resistance, and high durability.

SUMMARY OF THE INVENTION

The present invention provides apparatus, systems and methods in which an elastic overshoe has an outer layer through which extend a plurality of protrusions.

In preferred embodiments the overshoe comprises inner and outer layers; the outer layer having a plurality of openings, and the inner layer including the protrusions that extend through the plurality of openings.

Contemplated overshoes can have any suitable sizes and shapes, to accommodate different sizes and shapes of shoes. Thus, overshoes can well be manufactured in at least small, medium and large sizes, and possibly in various widths. To accommodate different size shoes, the overshoes are preferably elastically stretchable (by a user) to at least 1.1, 1.2, 1.3 times their resting length. Stretchability is preferably facilitated by one or more of: (a) the thinness of the outer layer (e.g., 2-8 mm thick); (b) inclusion of openings between the ball and heel regions; and (c) use of elastomeric materials. Unless otherwise expressly stated, all ranges here are inclusive of their endpoints. Contemplated elastomeric materials include nitrile rubber, as well as any other materials that provide suitable strength, flexibility, and strechability.

Although it is contemplated to manufacture overshoes that have only a ball/toe or heel regions, preferred overshoes cover extend from the toe to the heel. Similarly, although it is contemplated to manufacture overshoes with little or no side walls, preferred overshoes have a substantial side wall measuring at least 2, 3, 4, or 5 cm high. Overshoes can have any suitable thickness, including thicknesses from less than 2 mm to 8 mm or more. Moreover, thickness can vary in different regions.

The openings can have any practical size, shape, orientation and arrangement of openings, although of course at least some of the openings must be aligned with at least some of the protrusions, and ideally the protrusions will fit snugly within the openings to avoid tearing of the openings. Preferred openings are ovoid, and perhaps circular, and it is contemplated that at least some of the plurality of openings can be sized and/or shaped differently from others. Overshoes can also have any practical number of openings, including especially at least 20, 40, 60, or 80. At least 10-20 openings, for example, can positioned be at the bottom of the heal region, and another 10-20 openings can be at the sides or back of the heal region. Similarly, at least 30-50 openings can be positioned at the bottom of the ball region, and another 10-20 openings can be at the sides or toe region of the ball region. Still further, openings can be positioned intermediate between the ball and heel regions. Not all of the openings need to be aligned with protrusions.

Each of the protrusions preferably aligns with one, and only one of the openings, although it is possible that multiple protrusions could align with a single opening. Protrusions preferably extend through the openings by about 2-8 mm, and more preferably by about 4-6 mm. Protrusions are preferably flattened on their ends, with rounded edges. That shape is intended to facilitate slip resistance.

The inner layer would typically be sandwiched between the shoe and the outer layer. Inner layers can be any practical sizes and shapes, but in commercially successful products would likely either substantially match the length of the pocket formed by the outer layer, or would comprise separate ball and/or heel pieces. In the case of heel pieces, for example, the inner layer would not extend to the ball region, so that the protrusions would extend only from the heel region, or possibly from the heel region and also part of the intermediate region.

The inner and outer layers can advantageously have different chemical compositions. The inner layer, for example, can be tougher, while the outer layer could be more stretchable.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
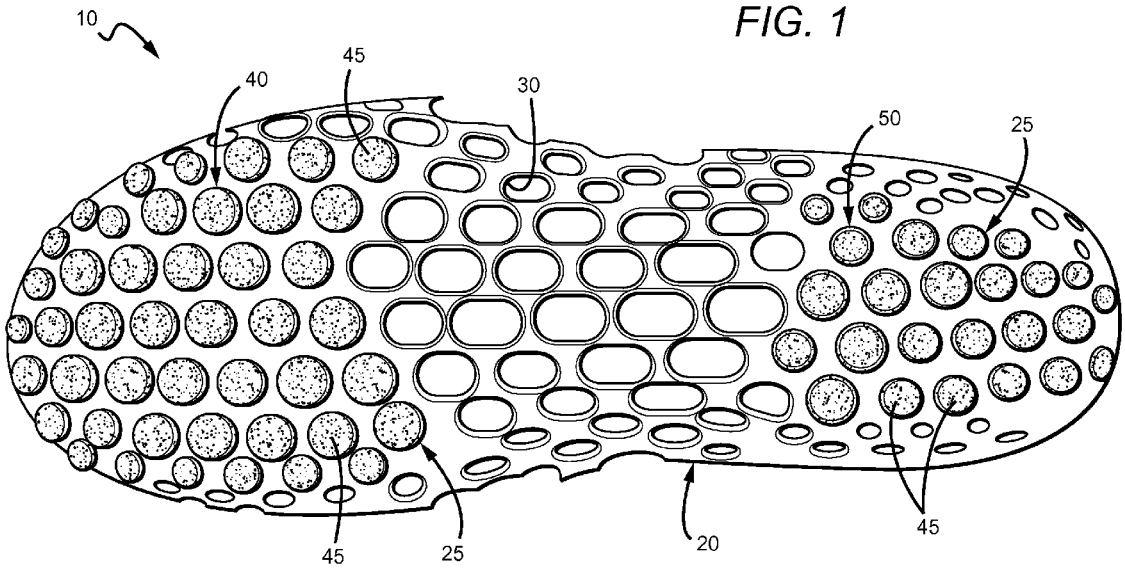
FIG. 1 is a perspective view of the present inventive subject matter.
Figure 2:
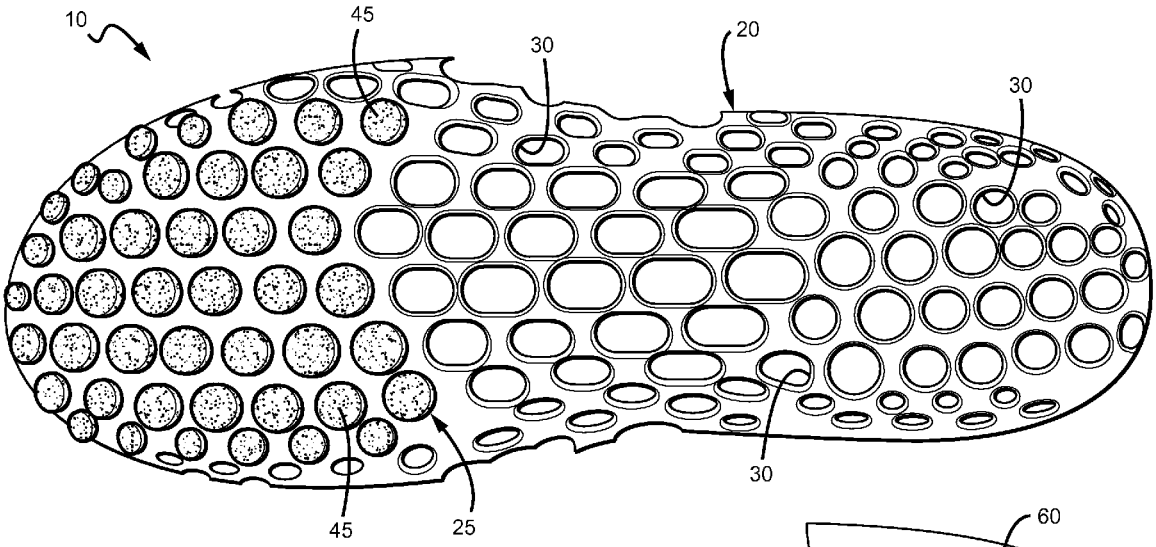
FIG. 2 is another perspective view of FIG. 1 with one sole pad.

In FIGS. 1 and 2, an overshoe 10 generally comprises an outer layer 20 and an inner layer 25. The inner layer in this particular embodiment has separate ball segment 40 and heel segment 50.

Those skilled in the art will appreciate that the terms "inner" and "outer" are employed primarily for convenience of description of their overall relative positioning, and should really be read as two layers. Thus, even though outer layer 20 may have an outer coating upon it, and even though the protrusions of inner layer 25 extend out through the openings of outer layer 20, the outer layer is still referred to as "outer". Similarly, inner layer 25 is named as such because it is substantially sandwiched between the outer layer 20 and the shoe upon which the overshoe is placed. One could, for example, properly refer to inner layer 20 and outer layer 25 as first layer and second layer, respectively.

Outer layer 20 has openings 30 disposed across the sole, as well as the sides and back (heel counter). Where there are many openings positioned fairly close together, the outer layer can take on a web-like appearance, as shown. Here the openings 30 all have various ovoid shapes that can accommodate corresponding protrusions from the inner ball and heel regions. However, it is contemplated that openings can be any size, shape, and dimensions. Openings 30 can vary in sizes across the outer layer. It is possible that the front or ball area of the outer layer 20 has smaller openings than the back or heel of the outer layer. But the reverse is also contemplated. The intermediate region between the ball and the heel has openings of yet other sizes and/or shapes, or no openings at all. The configuration of the openings can depend on the type of overshoe.

With particular reference to FIG. 1, outer layer 20 is configured to slip over a regular work or dress shoe, and to fit snugly or even tightly thereabout. To that purpose outer layer 20 is advantageously molded to fit overtop of a typically shaped athletic or dress shoe. Various alternative embodiments are contemplated for women's shoes, such as uppers that have a pointed front, but such embodiments are not preferred. Outer layer 20 could be configured to be generic with respect to footedness, i.e. the same overshoe would work equally well with a right foot and a left foot. As with other overshoes, outer layer 20 can slips over a regular shoe by inserting the regular shoe and pulling the overshoe onto the regular shoe. Zippers (not shown) or other insertion aid are also contemplated. The overshoe can be removed by simply pulling it off of the regular shoe.

Outer layer 20 is preferably one continuous piece of elastic material. As used herein, the term "elastic" refers to something that stretches to a significant extent, and then substantially returns to its original shape. Preferred elastic materials include various forms of rubbers or other polymers, including especially thermoplastic rubbers. Various different thermoplastic rubbers and thermoplastic elastomers are suitable.

Figure 3:
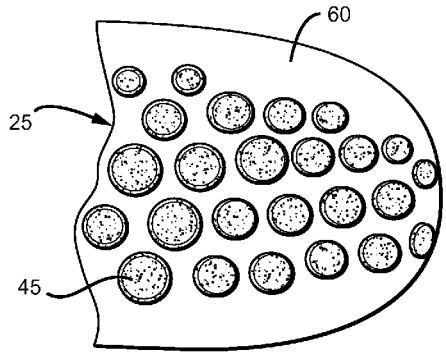
FIG. 3 is top perspective view of another sole pad.
Figure 4:
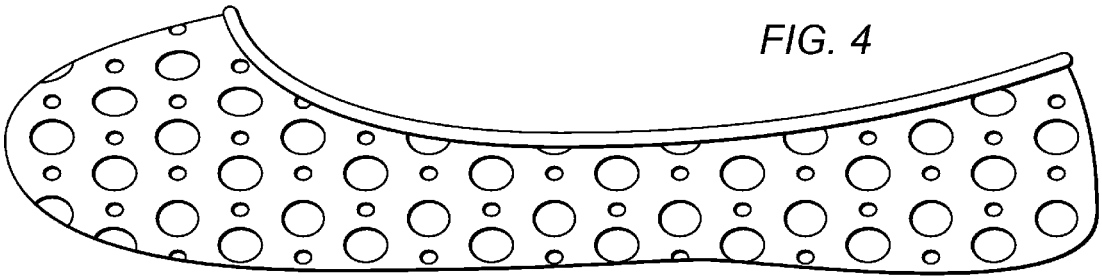
FIG. 4 is a side perspective view of the present inventive subject matter.

According to FIGS. 2 and 3, inner layer 25 comprises base 60 and protrusions 50.

Protrusions 50 preferably cover the entire inner layer 25. Protrusions 50 are presented as a web-like structure across the inner layer. Preferably, protrusions 50 are of ovoid shapes that can accommodate corresponding openings form the outer layer. However, it is contemplated that protrusions can be any size, shape, and dimensions. To be more flexible, protrusions 50 can vary in sizes across the inner layer.

Inner layer 25 can be one single continuous piece or it can be in separate pieces. Preferably, the inner layer has an inner ball region 40 and an inner heel region 50. Thus, the protrusions on the inner ball region can be different than the inner heel region. The key is that the protrusion has to match a corresponding opening on the outer layer. So as long as they match, their sizes and shapes can vary.

Protrusions 50 are preferably pushed through the openings to secure the inner layer being disposed in the outer layer. To make sure that the protrusions are tightly secured to the openings, it is preferred that the protrusions are slightly less in diameter than the openings. Through force, the protrusions still can be pushed through the openings, but once push through, the protrusions are secured.

Figure 5:
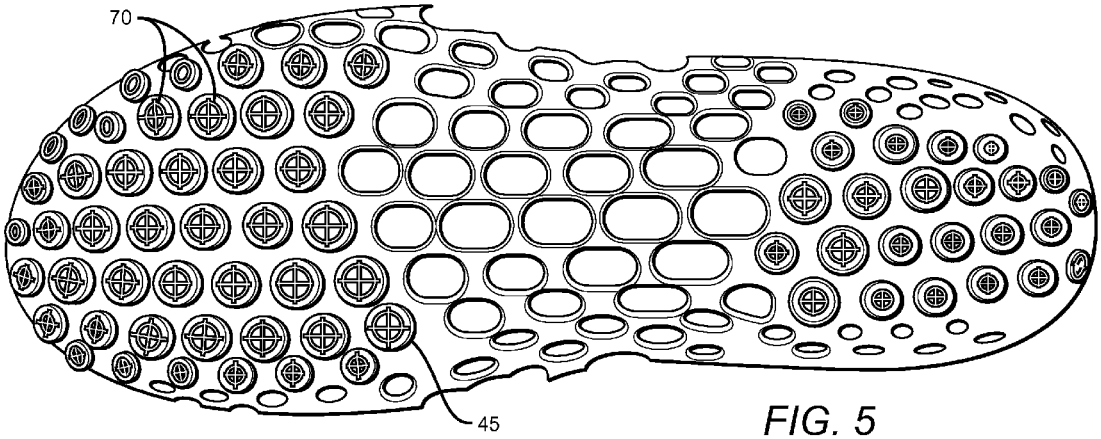
FIG. 5 is another perspective view of the present inventive subject matter.

Protrusions 50 preferably have a tread pattern as shown in FIG. 5. However, it is contemplated that protrusions 50 can be smooth depending on the material and need. Tread pattern 70 can be any pattern that provides stability to the overshoe.

Inner layer can be made of a variety of materials. Preferably, inner layer is made of a material that is slip-resistant regards to the surface of a road. Also preferably, the inner layer is made of flexible material that allows the overshoe to bend and move as the user is moving. Depending on the road and weather condition, the inner layer can be made of different materials. For example, during winter months where roads can be slippery and wet, a preferred inner layer can be made of metal, such as steel to provider greater security. Additionally, the inner layer can have cleats or other tread pattern to provide stability. For use in wet conditions, the inner layer can be made of materials that are much softer and have a greater suction ability. Again, depending on the environmental factors, the inner layer can be changed accordingly.

Inner layer 25 can also be laminated or homogenous. Still further, the inner layer may comprise a base made of a different material from the protrusions. For example, the base could be made from a relatively elastic and flexible material, such as nitrile rubber, while the protrusions could be made of the same nitrile rubber, but capped with a harder rubber or plastic to provide longer wear.

Contemplated usage can be quite straightforward. Users can simply insert one or more inner layers into the outer layer, by pushing the protrusions through corresponding openings. Among other things, this allows users to readily change the protrusions depending on the desired properties, such as greater or lesser slip resistance, or to replace worn out protrusions. Since protrusions need not extend through all openings, changing of protrusions also allows users to change tread patterns without changing the outer layer.

Thus, specific embodiments and applications of elastic overshoes with sandwiched sole pads have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps can be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An elastic overshoe for placement over a shoe, comprising:

an elastic outer layer with a plurality of openings through at least a ball region, a heel region, and an intermediary region between the ball and heel region of the outer layer, the outer layer configured to cover at least a sole portion of the shoe;

an inner layer comprising a changeable ball segment and a separate changeable heel segment, each with a plurality of protrusions that extend through the plurality of openings in the ball region and heel region of the outer layer, respectively; and wherein the openings through the intermediary region lack protrusions from the inner layer when the segments of the inner layer are secured within the outer layer.

2. The overshoe of claim 1, wherein the outer layer is sized and dimensioned to cover both ball and heel regions of the shoe.

3. The overshoe of claim 1, wherein the outer layer has a resting length, and is elastically stretchable to at least 1.2 times its resting length.

4. The overshoe of claim 1, wherein at least some of the plurality of openings are curved.

5. The overshoe of claim 1, wherein at least some of the plurality of openings are sized differently from others of the plurality of openings.

6. The overshoe of claim 1, wherein at least some of the plurality of openings are shaped differently from others of the plurality of openings.

7. The overshoe of claim 1, wherein at least some of the plurality of openings are positioned in a side wall of the outer layer.

8. The overshoe of claim 1, wherein at least some of the plurality of openings are positioned in a back wall of the outer layer.

9. The overshoe of claim 1, wherein the outer layer has a thickness of between 2 and 8 mm, inclusive.

10. The overshoe of claim 1, wherein the plurality of openings numbers at least ten.

11. The overshoe of claim 1, wherein the inner layer segments are removable from the outer layer without damaging either of the layers.

12. The overshoe of claim 1, wherein the outer layer has a ball region, an intermediate region, and a heel region, and the protrusions do not extend through the ball region.

13. The overshoe of claim 1, wherein the outer layer has a ball region, an intermediate region, and a heel region, and the protrusions do not extend through the heel region.

14. The overshoe of claim 1, wherein at least some of the protrusions comprise a slip resistant material.

15. The overshoe of claim 1, wherein the inner and outer layers have different chemical compositions.

16. The overshoe of claim 1, wherein at least one of the ball and heel segments comprise metal protrusions.

* * * * *